US007188901B2

(12) United States Patent
Helmond et al.

(10) Patent No.: US 7,188,901 B2
(45) Date of Patent: Mar. 13, 2007

(54) CHAIR ADJUSTMENT MECHANISM

(75) Inventors: Gerard Helmond, Waterloo (CA); Kenneth A. Beggs, Waterloo (CA); David Watkins, Waterloo (CA)

(73) Assignee: Leggett & Platt Ltd., Waterloo (CA)

( * ) Notice: Subject to any disclaimer, the term of this patent is extended or adjusted under 35 U.S.C. 154(b) by 0 days.

(21) Appl. No.: 11/015,610

(22) Filed: Dec. 17, 2004

(65) Prior Publication Data

US 2006/0131944 A1 Jun. 22, 2006

(51) Int. Cl.
*A47C 7/40* (2006.01)

(52) U.S. Cl. ..... 297/353; 297/411.36

(58) Field of Classification Search ..... 297/353, 297/411.36, 408, 410; 292/288, 289, 292, 292/295, 300, 302, DIG. 61, DIG. 63; 403/377, 403/378, 379.5
See application file for complete search history.

(56) References Cited

U.S. PATENT DOCUMENTS

| | | | | |
|---|---|---|---|---|
| 979,149 | A | 12/1910 | Gay | |
| 1,210,199 | A | 12/1916 | Passeck | |
| 1,400,960 | A | 12/1921 | Lambert | |
| 1,569,708 | A | 1/1926 | Burns et al. | |
| 2,256,856 | A | 9/1941 | Zwald | |
| 2,830,653 | A | 4/1958 | Gaugler | |
| 2,886,097 | A * | 5/1959 | Katz | 297/112 |
| 3,162,416 | A | 12/1964 | Amarillas | |
| 4,043,592 | A | 8/1977 | Fries | |
| 4,451,084 | A | 5/1984 | Seeley | |
| 4,639,039 | A | 1/1987 | Donovan | |
| 4,660,885 | A | 4/1987 | Suhr et al. | |
| 4,749,230 | A | 6/1988 | Tornero | |
| 5,037,158 | A | 8/1991 | Crawford | |
| 5,324,096 | A | 6/1994 | Schultz | |
| 5,388,892 | A | 2/1995 | Tornero | |

(Continued)

FOREIGN PATENT DOCUMENTS

| | | |
|---|---|---|
| DE | 247821 | 4/1911 |

(Continued)

*Primary Examiner*—Peter M. Cuomo
*Assistant Examiner*—Joe Edell
(74) *Attorney, Agent, or Firm*—Shook, Hardy & Bacon, L.L.P.

(57) ABSTRACT

A chair adjustment mechanism has a pin retaining member (as, for example, a sleeve) with a slot having two laterally spaced pin receptors. Each receptor is partially defined by a peripheral wall of the slot and is further defined by a spring finger that projects along side of the peripheral wall. With this arrangement, a pin may be received through the slot and into a longitudinal slot of a second member (as, for example, a J-bar), which longitudinal slot defines a rack. The pin receptors may be positioned such that with the pin in a first of the pin receptors, it is engaged by the rack. In consequence, the pin retaining member may be moved upwardly with respect to the second member by notching the pin over teeth of the rack against the urging of the spring finger. The top of the longitudinal slot may have a cam surface to cam the pin into the second pin receptor such that the pin is now spaced from the rack. This releases the pin retaining member to be lowered with respect to the second member. The longitudinal slot may have a second cam surface proximate its bottom end to again cam the pin into the rack.

14 Claims, 8 Drawing Sheets

U.S. PATENT DOCUMENTS 5,397,196 A * 3/1995 Boiret et al. ..... 403/348
5,597,204 A * 1/1997 Karaus, Jr. ..... 297/353
5,649,741 A 7/1997 Beggs
5,685,609 A * 11/1997 Miotto ..... 297/353
5,735,577 A * 4/1998 Lin ..... 297/411.36
5,765,920 A * 6/1998 Lai ..... 297/411.36
5,951,107 A * 9/1999 Tornero ..... 297/353
6,264,276 B1 * 7/2001 Chen ..... 297/353
6,276,757 B1 * 8/2001 Brown ..... 297/353
6,299,253 B1 * 10/2001 Chen ..... 297/353
6,709,059 B1 * 3/2004 Cvek ..... 297/353

FOREIGN PATENT DOCUMENTS

GB 636573 5/1950

* cited by examiner

CHAIR ADJUSTMENT MECHANISM

BACKGROUND OF INVENTION

This invention relates to a chair adjustment mechanism and to a chair incorporating such a mechanism.

Modern desk chairs have a variety of adjustments that allow the chair to be conformed to the preferences of the occupant. Commonly, such chairs allow for vertical adjustment of the backrest. In U.S. Pat. No. 5,649,741 to Beggs, a J-bar extends upwardly from the seat of the chair and receives a sleeve which is attached to the backrest. The J-bar has a vertical slot with a plurality of teeth along one side that define a rack. A pawl is positioned within the vertical slot; the pawl has a pin projecting from each of its sides into an inverted L-shaped slot in each of the front and back walls of the sleeve. The pawl is backed by a bar that is urged by a leaf spring, such that the pawl is urged into engagement with the teeth of the rack. The teeth of the pawl and of the rack are configured so that, with the pawl urged into engagement with the rack, the pawl may be ratcheted upwardly, but not downwardly. As such, the vertical position of the backrest may be selected by a user. The configuration of the vertical slot, in combination with the inverted L-shaped slots, may be used to latch the pawl out of the rack to again lower the backrest.

While the mechanism of Beggs is advantageous, a mechanism of less costly manufacture would be even more advantageous.

SUMMARY OF INVENTION

A chair adjustment mechanism has a pin retaining member (as, for example, a sleeve) with a slot having two laterally spaced pin receptors. Each receptor is partially defined by a peripheral wall of the slot and is further defined by a spring finger that projects along side of the peripheral wall. With this arrangement, a pin may be received through the slot and into a longitudinal slot of a second member (as, for example, a J-bar), which longitudinal slot defines a rack. The pin receptors may be positioned such that with the pin in a first of the pin receptors, it is engaged by the rack. In consequence, the pin retaining member may be moved upwardly with respect to the second member by notching the pin over teeth of the rack against the urging of the spring finger. The top of the longitudinal slot may have a cam surface to cam the pin into the second pin receptor such that the pin is now spaced from the rack. This releases the pin retaining member to be lowered with respect to the second member. The longitudinal slot may have a second cam surface proximate its bottom end to again cam the pin into the rack.

In accordance with an embodiment of the invention, there is provided a chair adjustment mechanism comprising a pin retaining member, said pin retaining member having a slot having two laterally spaced pin receptors, each receptor partially defined by a peripheral wall of said slot and further defined by a spring finger that projects along side of said peripheral wall.

In accordance with another aspect of the invention, there is provided a chair comprising: a seat; a J-bar extending upwardly from said seat, said J-bar having a vertical slot with teeth extending along one side to define a rack; a sleeve receiving said J-bar, said sleeve having a face with a pin retaining slot having two horizontally spaced pin receptors, each receptor partially defined by a peripheral wall of said pin retaining slot and further defined by a spring finger that projects along side of said peripheral wall; and a pin retained by said pin retaining slot and extending into said vertical slot.

Other features and advantages of the present invention will be apparent from the following description, in conjunction with the drawings.

BRIEF DESCRIPTION OF THE DRAWINGS

In the figures which illustrate example embodiments of the invention.

DETAILED DESCRIPTION

Figure 1:
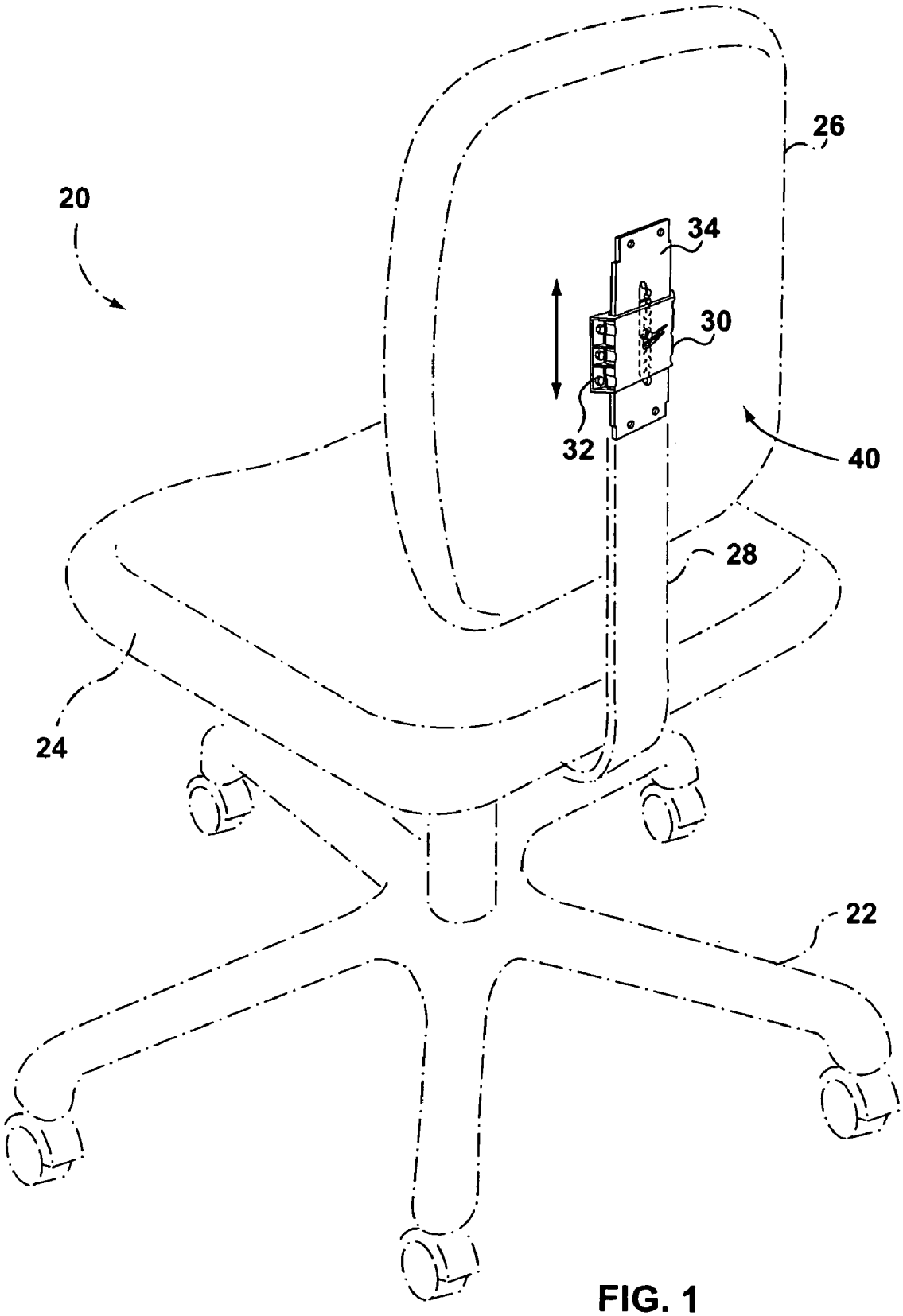
FIG. 1 is a perspective view of a chair incorporating a chair adjustment mechanism made in accordance with this invention.

Turning to FIG. 1, a chair 20 has a base 22, a seat 24, and a backrest 26. A J-bar 28 extends upwardly from the underside of the seat 24. The backrest 26 has a sleeve 30 affixed thereto by fasteners 32. The sleeve receives the top portion of the J-bar 28. As shown, the top portion of the J-bar is a separate plate 34 fastened to the remainder of the J-bar. As will be described, plate 34 and sleeve 30 act as a chair adjustment mechanism 40.

Figure 2:
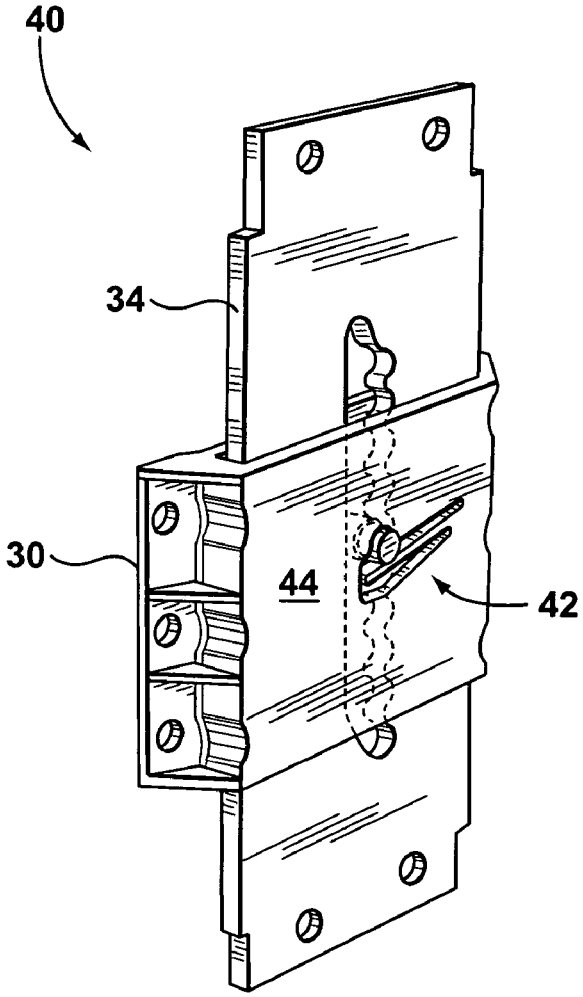
FIG. 2 is a front perspective view of the chair adjustment mechanism of FIG. 1.
Figure 3:
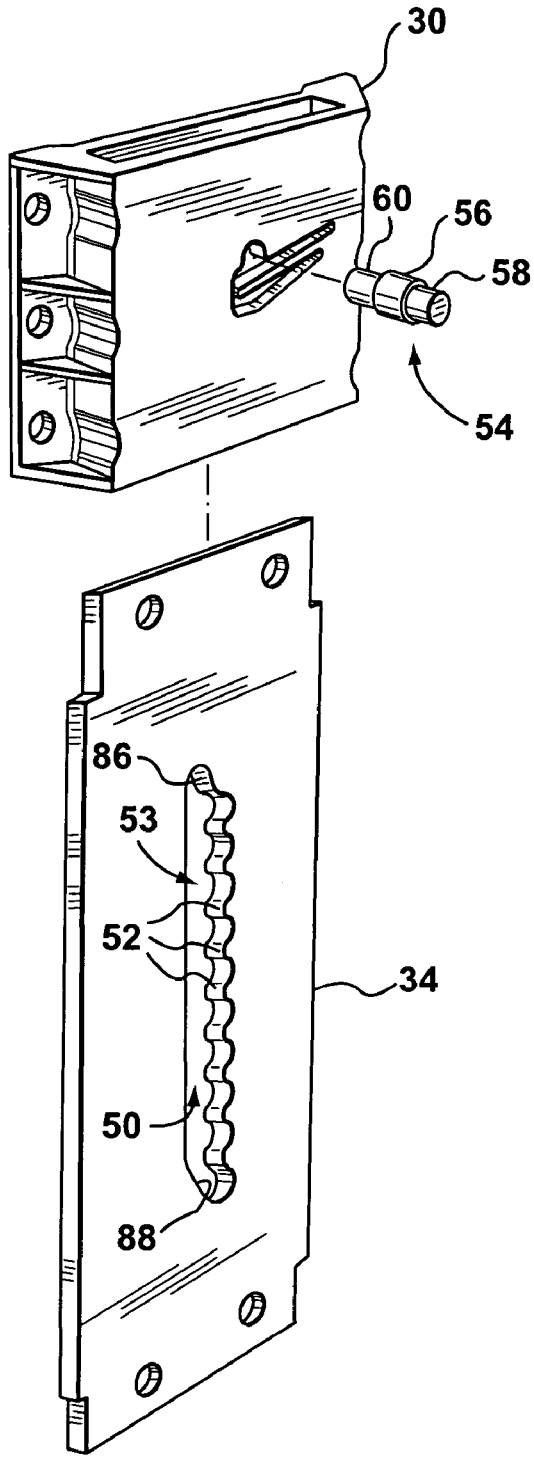
FIG. 3 is an exploded view of the mechanism of FIG. 2.
Figure 4:
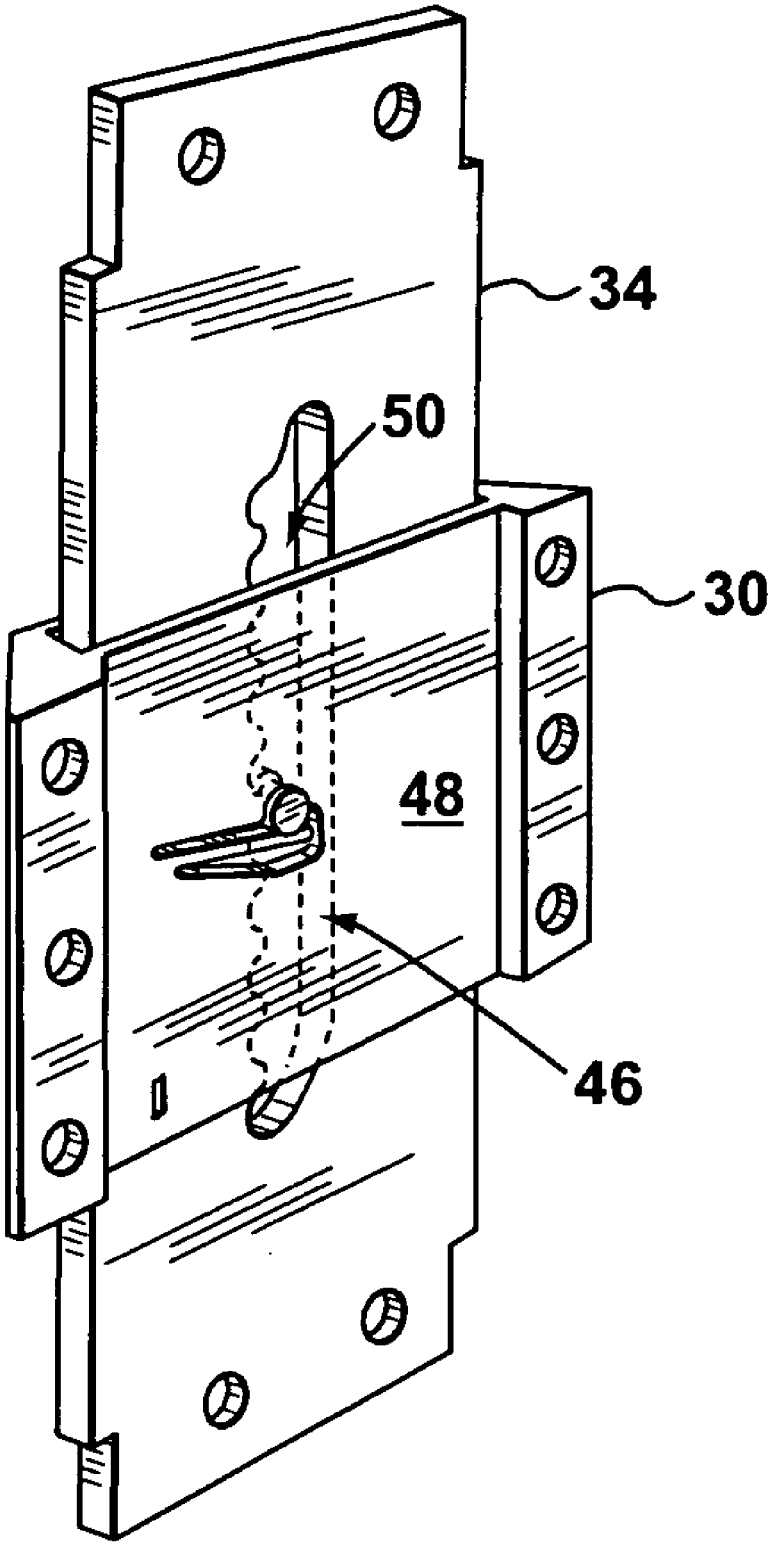
FIG. 4 is a rear perspective view of the mechanism of FIG. 2, FIGS. 5*a* and 6*a* are front views of the mechanism of FIG. 2, illustrating its operation.

Turning to FIGS. 2 to 4, it will be apparent that sleeve 30 has a slot 42 in its front wall 44 and an identical slot 46 in its back wall 48. The J-bar has a longitudinal slot 50 with teeth 52 extending along one side to define a rack 53. A pin 54 has an enlarged diameter middle section 56 and smaller diameters ends 58, 60. The pin extends through slots 42, 50 and 46 such that the middle section of the pin is within longitudinal slot 50 and ends 58 and 60 are within slots 42 and 46, respectively.

Figure 3A:
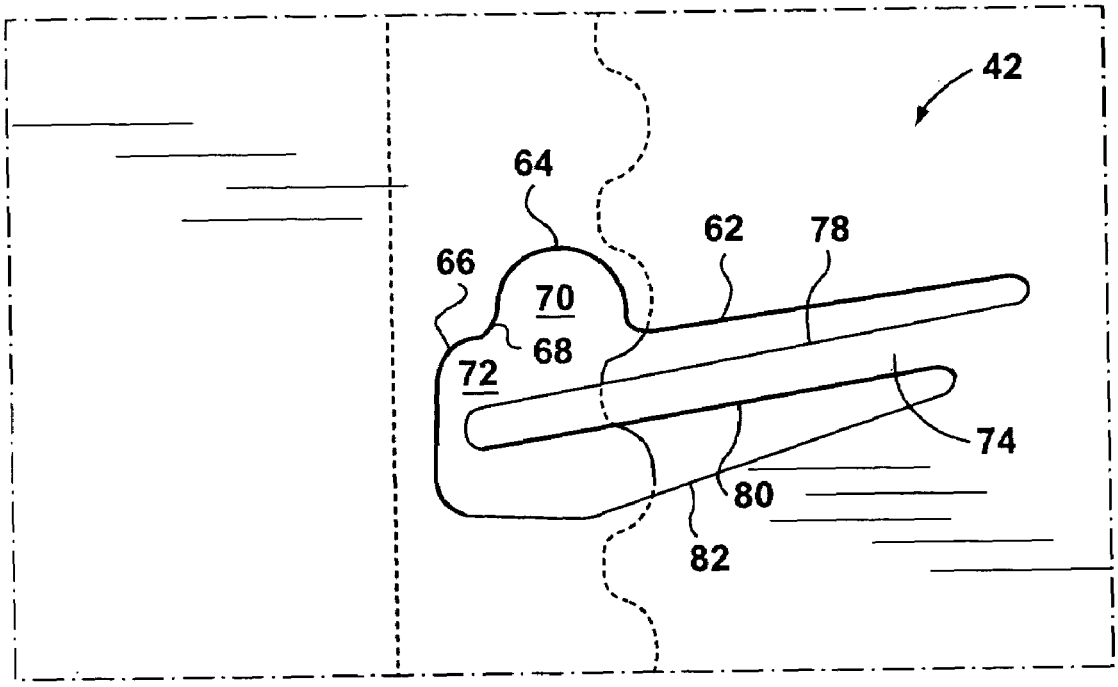
FIG. 3*a* is an enlarged view of a portion of FIG. 3.

From FIG. 3*a*, it will be apparent that slot 42 has a first peripheral slot wall 62 with a first concavity 64 and a laterally spaced second concavity 66 with a convexly radiused section 68 of wall 62 between them. These concavities partially define two laterally spaced pin receptors: receptor 70 and receptor 72. The receptors are further defined by a spring finger 74 that projects along side of the first peripheral slot wall 62. It will be apparent that the spring finger 74 is integrally formed with the front wall 44 of the sleeve 30 and thus defines medial walls 78, 80 of slot 42. The slot 42 has a second peripheral wall 82 opposite the first peripheral wall 62; the spring finger projects between these walls 62, 82.

The sleeve 30 may be fabricated of a stiff, but resilient plastic material, such as glass reinforced nylon, in order to provide an integral resilient spring finger 74.

Referencing FIG. 3, longitudinal slot 50 has an upper cam surface 86 proximate the top of the slot and a lower cam surface 88 proximate the bottom of the slot.

Figure 5A:
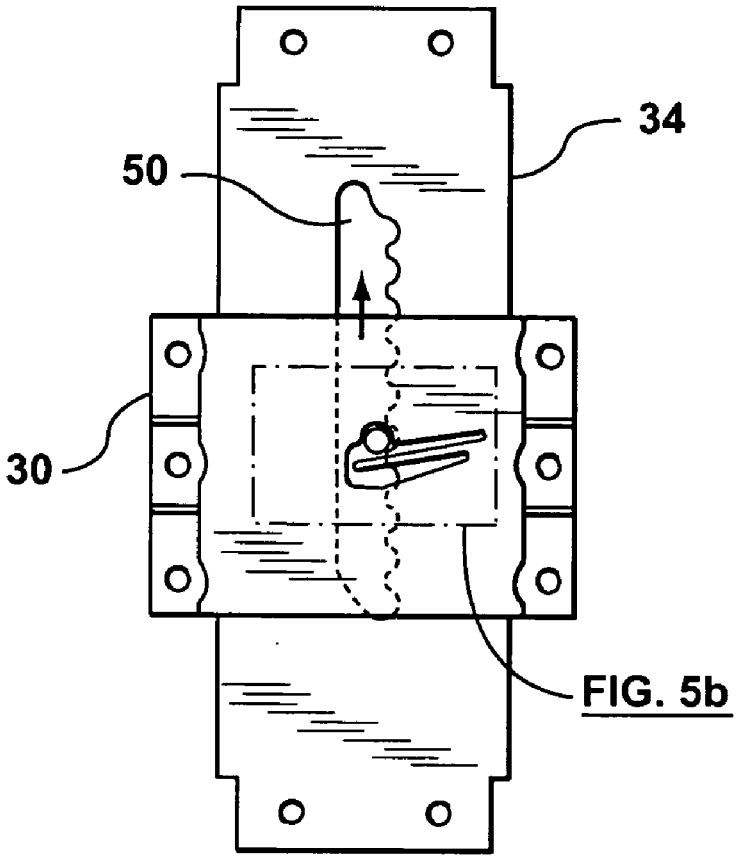
FIG. 5*b* is an enlarged views of the area marked FIG. 5*b* in FIG. 5*a*.
Figure 5B:
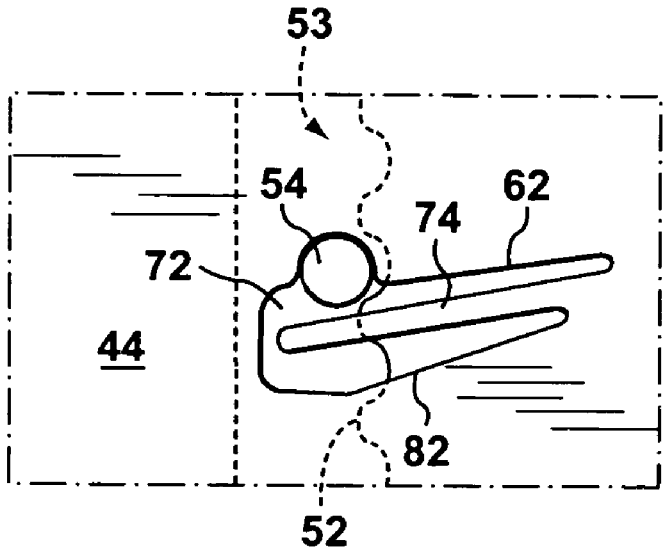
Figure 6A:
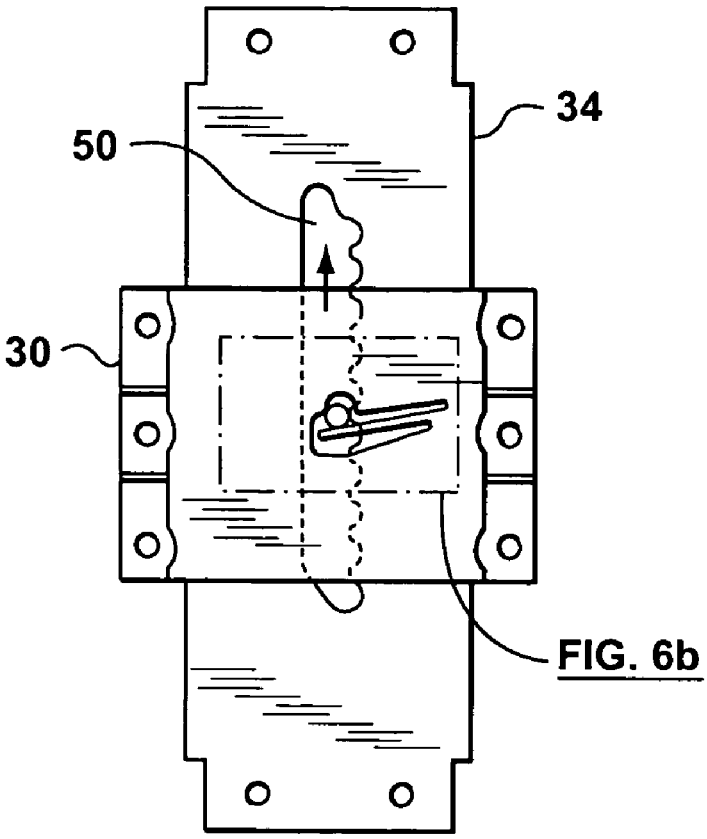
FIG. 6*b* is an enlarged views of the area marked FIG. 6*b* in FIG. 6*a*, FIGS. 7, 8, and 9 are front views of the mechanism of FIG. 2, illustrating its operation.
Figure 6B:
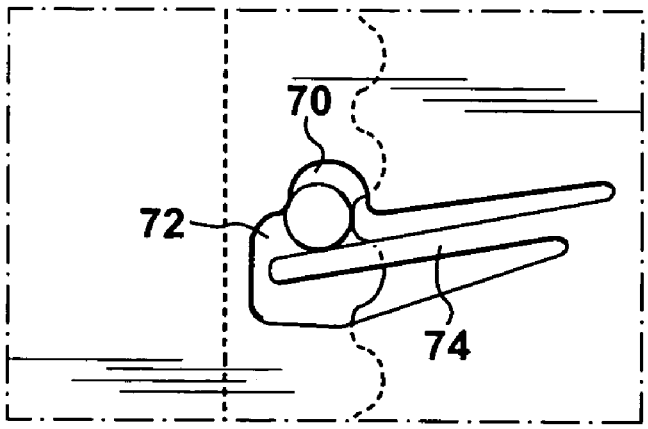

With reference to FIGS. 5*a* and 5*b*, when the pin 54 is in the first receptor 70, the middle section of the pin is held by adjacent teeth 52 of rack 53. Any downward force on sleeve 30 will simply cause these teeth 52 to jam pin 54 in receptor 70. Consequently, the sleeve 30 is precluded from moving downwardly on plate 34. However, as shown in FIGS. 6*a* and 6*b*, an upward force on sleeve 30 can push pin 54 out of concavity 64, against the urging of spring finger 74. This allows the pin 54 to notch over the top one of the two teeth 52 between which it had been held, whereupon the spring finger will urge the pin to again fully seat in concavity 64. However, the pin is now held by a different, more upwardly located, pair of teeth. In this way, sleeve 30 may be displaced upwardly one notch on rack 53 of plate 34. This process may be repeated to raise sleeve 30 to any desired extent with respect to plate 34, at least until the top of slot 50 is encountered.

Figure 7:
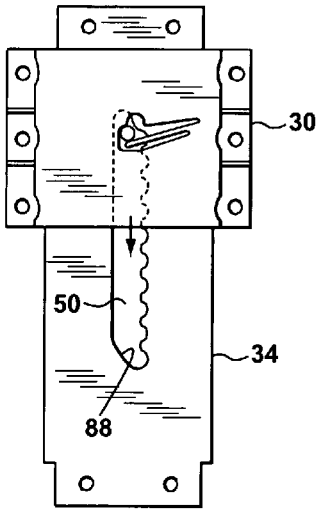
Figure 8:
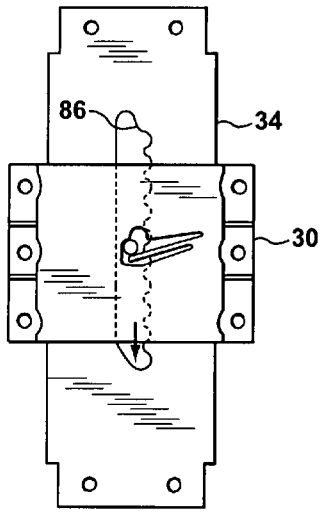

With reference to FIG. 7, when the pin encounters cam surface 86 proximate the top of slot 50, further upward movement of sleeve 30 will result in the cam surface 86 camming the pin 54 out of receptor 70 and into receptor 72, against the urging of spring finger 74. With the pin in receptor 72, the spring finger 74 is perpetually deformed, which acts to retain the pin 54 in receptor 72. While in receptor 72, the pin 54 is laterally spaced from rack 53. In consequence, as indicated by FIG. 8, sleeve 30 is now free to slide down (or up) with respect to plate 34.

Figure 9:
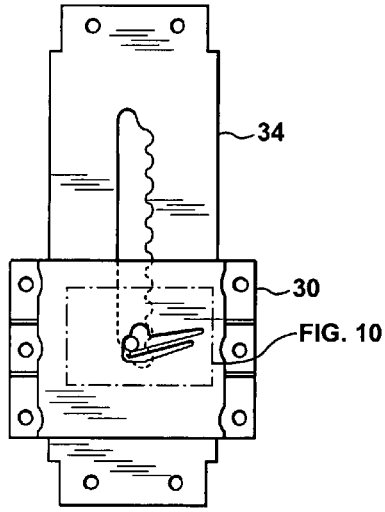
Figure 10:
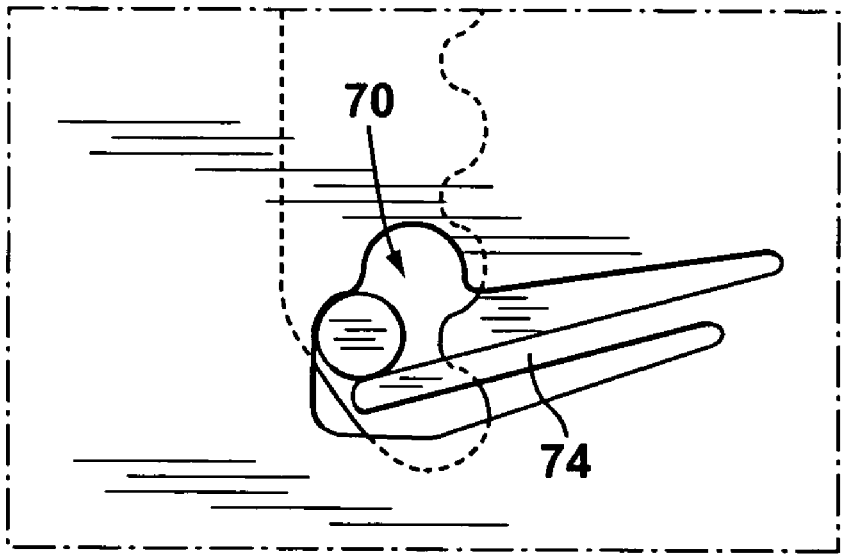
FIG. 10 is an enlarged view of the area marked FIG. 10 in FIG. 9.
Figure 11:
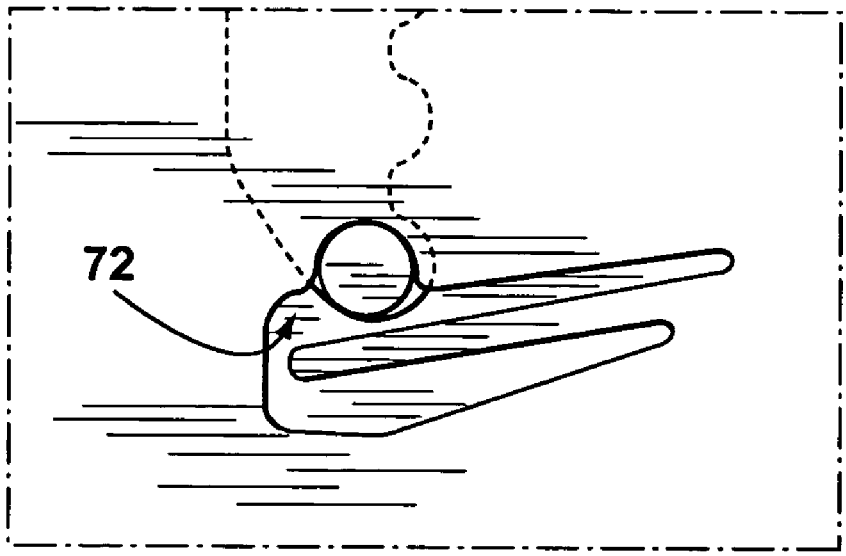
FIG. 11 is an enlarged view of the area of FIG. 10, shown at a different point of operation.

If, as shown in FIG. 9, the sleeve is slid to the bottom of the slot 50, pin 54 will encounter cam surface 88. Further downward movement of sleeve 30 will result in cam surface 88 camming pin 54 back in to receptor 70, against the urging of spring finger 74. This progression is illustrated in FIGS. 10 and 11. Thus, once again, pin 54 is engaged by the rack such that the sleeve may only move upwardly by notching the pin over the top of teeth 52 of the rack.

From the foregoing, it will be apparent that a user may notch the backrest 26 of the chair 20 upwardly to a desired vertical position. If the user overshoots the desired position, or a subsequent user wishes to set the backrest at a lower position, the backrest is moved as far upwardly as possible, whereupon it is then moved as far downwardly as possible. Thereafter, the backrest may again be notched upwardly to a desired position.

While the operation has been described with reference to the front face 44 of sleeve 30 with its slot 42, the same operation occurs with reference to the back face 48 of the sleeve and its slot 46. The slots 42, 46 co-operate to control both ends of the pin 54, thereby reducing the chance of jamming.

With reference to FIGS. 3 and 3*a*, in order to assemble mechanism 40, sleeve 30 is slid over plate 34 so that receptor 70 of slot 42 is aligned with the portion of longitudinal slot 50 which is adjacent cam surface 88. The spring finger 74 of slot 42 is then deflected to allow the pin 54 to be inserted into receptor 70 and into longitudinal slot 50. The spring finger of slot 46 (FIG. 4) is then deflected to allow further insertion of the pin so that end 60 of the pin is received by the receptor of slot 46 which corresponds to receptor 70 of slot 42.

It may be possible to provide a sufficiently stable chair adjustment mechanism by controlling only one end of pin 54. If so, a slot is only required in one face of sleeve 30.

While the mechanism 40 has been described as having a plate 34 which is fastened to the remainder of the J-bar 28, equally, the J-bar may be a one piece bar with a longitudinal slot 50. Further, it may be possible to provide a longitudinal slot identical to longitudinal slot 50 in each face 44, 48 of the sleeve in place of slots 42, 46. In such instance, a slot identical to slot 42 may be formed in the J-bar. With this arrangement, pin may have enlarged ends and a smaller diameter middle section.

While the spring finger 74 has been described as integrally formed with sleeve 30, optionally, the spring finger may be a separate piece which is joined to the sleeve.

While the concavities 64, 66 have been described as being spaced by convexly radiused section 68, they may spaced laterally to a greater degree provided the cam surfaces 86 and 88 are configured to cam the pin between receptors 70 and 72 against the urging of the spring finger 74.

While the adjustment mechanism has been described for use in the height adjustment of the backrest of a chair, it may also be used in other chair adjustment mechanisms, such as an armrest height adjustment mechanism.

Other modifications will be apparent to those skilled in the art and, therefore, the invention is defined in the claims.

What is claimed is:

1. A chair adjustment mechanism comprising:

a pin retaining member, said pin retaining member having a slot having two laterally spaced pin receptors, each receptor partially defined by a first peripheral wall of said slot and further defined by a spring finger that projects alongside of said first peripheral wall said spring finger projecting between said first peripheral slot wall and a second peripheral slot wall opposite said first peripheral slot wall;

said spring finger being integrally formed with said pin retaining member such that walls of said spring finger are medial walls of said slot; and a first pin receptor of said receptors being spaced from a second pin receptor of said receptors by a convexly radial section of said first peripheral slot wall.

2. The mechanism of claim 1 further comprising a rack bearing member, said rack bearing member having a longitudinal slot with teeth extending along one side to define a rack.

3. The mechanism of claim 2 wherein one of said pin retaining member and said rack bearing member is a sleeve and said other of said pin retaining member and said rack bearing member is a bar, said sleeve receiving said bar.

4. The mechanism of claim 3 further comprising a pin received by one of said receptors of said pin retaining member and extending into said longitudinal slot of said rack bearing member.

5. The mechanism of claim 4 wherein when said pin is received by said first pin receptor of said pin receptors, said pin engages teeth of said rack and when said pin is received in said second pin receptor of said pin receptors, said pin does not engage teeth of said rack.

6. The mechanism of claim 5 wherein said pin perpetually tensions said spring finger when said pin is received by said second pin receptor.

7. The mechanism of claim 6 further comprising a cam surface at an upper end of said longitudinal slot, said cam surface for camming said pin out of said first pin receptor and into said second pin receptor against the urging of said spring finger.

8. The mechanism of claim 7 further comprising a second cam surface at a lower end of said longitudinal slot, said second cam surface for camming said pin out of said second pin receptor and into said first pin receptor against the urging of said spring finger.

9. The mechanism of claim 6 wherein said bar comprises said rack bearing member and said sleeve comprises said pin retaining member.

10. The mechanism of claim 9 wherein said slot is a first slot in a first face of said sleeve and further comprising a second slot, identical in configuration to said first slot, in a second, opposite face of said sleeve.

11. The mechanism of claim 10 where said pin is cylindrical and has a larger diameter middle section extending within said longitudinal slot of said bar and smaller diameter ends, each end extending within one of said first slot and said second slot of said sleeve.

12. The mechanism of claim 1 wherein said each receptor comprises a concavity in said first peripheral slot wall.

13. A chair comprising:

a seat;

a J-bar extending upwardly from said seat, said J-bar having a vertical slot with teeth extending along one side to define a rack;

a sleeve receiving said J-bar, said sleeve having a face with a pin retaining slot having two horizontally spaced pin receptors, each receptor partially defined by a peripheral wall of said pin retaining slot and further defined by a spring finger that projects alongside of said peripheral wall; and a pin retained by said pin retaining slot and extending into said vertical slot, wherein said spring finger is integrally formed with said pin retaining member such that walls of said spring finger are walls of said slot;

said peripheral wall of said slot is a first peripheral slot wall and further comprising a second peripheral slot wall opposite said first peripheral slot wall, said spring finger projecting between said first peripheral slot wall and said second peripheral slot wall; and a first receptor of said receptors is spaced from a second receptor of said receptors by a convexly radial section of said first peripheral slot wall.

14. A chair adjustment mechanism comprising:

a pin retaining sleeve, said pin retaining sleeve having a first face with a first slot having two laterally spaced pin receptors, each receptor partially defined by a peripheral wall of said slot and further defined by a spring finger that projects alongside of said peripheral wall and is integrally formed with said pin retaining sleeve such that walls of said spring finger are walls of said first slot, said pin retaining sleeve having a second face opposite said first face, said second face having a second slot identical in configuration to said first slot and aligned with said first slot;

a bar having a longitudinal slot with teeth extending along one side to define a rack, said bar being received by said sleeve;

a cylindrical pin extending from said first slot to said second slot through said longitudinal slot, said pin being received by one of said spaced pin receptors of each of said first slot and said second slot, said pin having a larger diameter middle section extending within said longitudinal slot of said bar and smaller diameter ends, each of said ends extending within one of said first slot and said second slot of said sleeve.

* * * * *